US005163411A

United States Patent [19]

Koiwa et al.

[11] Patent Number: 5,163,411

[45] Date of Patent: Nov. 17, 1992

[54] CAPACITOR DISCHARGE IGNITION APPARATUS FOR AN INTERNAL COMBUSTION ENGINE

[75] Inventors: Mitsuru Koiwa; Shingo Morita, both of Himeji, Japan

[73] Assignee: Mitsubishi Denki Kabushiki Kaisha, Tokyo, Japan

[21] Appl. No.: 700,812

[22] Filed: May 16, 1991

[30] Foreign Application Priority Data

May 18, 1990 [JP] Japan ..... 2-126984

[51] Int. Cl.[5] ..... F02P 3/08

[52] U.S. Cl. ..... 123/605; 315/209 CD; 361/256

[58] Field of Search ..... 123/605, 596, 621; 315/209 CD; 361/256

[56] References Cited

U.S. PATENT DOCUMENTS 3,782,353 1/1974 Kammerer et al. ..... 123/596
3,921,606 11/1975 Habert ..... 315/209 CD
3,980,922 9/1976 Katsumata et al. ..... 123/621

FOREIGN PATENT DOCUMENTS 2220183 11/1973 Fed. Rep. of Germany ..... 123/621
53-14820 4/1978 Japan .
53-30591 7/1978 Japan .

*Primary Examiner*—Andrew M. Dolinar
*Attorney, Agent, or Firm*—Sughrue, Mion, Zinn, Macpeak and Seas

[57] ABSTRACT

A capacitor discharging type ignition apparatus for an internal combustion engine is disclosed in which a secondary winding voltage rises quickly and has an extended spark generation time as well. The apparatus includes an electrical power source 101, an ignition coil 104 having a primary winding and a secondary winding connected to a spark plug, the primary winding having a first end terminal, a second end terminal and a third intermediate terminal between the first and second end terminals, a first capacitor 103*a* connected between the electrical power source and one of the first and second end terminals of the primary winding so that it is charged by the electrical power source; a second capacitor 103*b* connected between the electrical power source and the intermediate terminal of the primary winding so that it is charged by the electrical power source; a signal generator 105 for generating an ignition signal in synchronism with the rotation of the engine; and a switch 107 for causing the first and second capacitors to simultaneously discharge through the primary winding in response to the ignition signal of the signal generator.

10 Claims, 4 Drawing Sheets

FIG. 2(a) TRIGGER SIGNAL
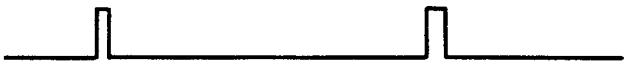
FIG. 2(b) CHARGING VOLTAGE
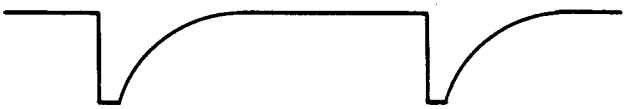
FIG. 2(c) ia
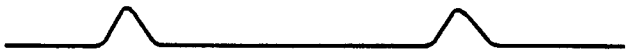
FIG. 2(d) ib
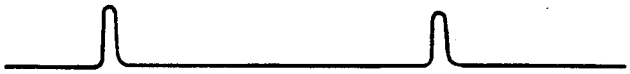
FIG. 2(e) ia + ib
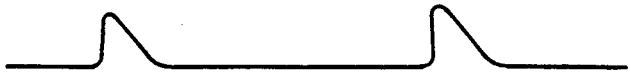
FIG. 2(f) V2
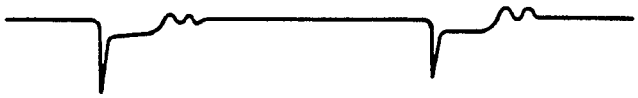
FIG. 2(g) I2
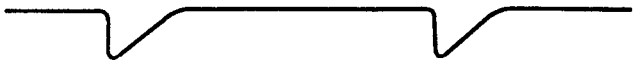

CAPACITOR DISCHARGE IGNITION APPARATUS FOR AN INTERNAL COMBUSTION ENGINE

BACKGROUND OF THE INVENTION

The present invention relates to a capacitor discharge type ignition apparatus for an internal combustion engine.

A typical example of such an ignition apparatus for an internal combustion engine is diagrammatically shown in FIG. 4. The ignition apparatus illustrated includes a DC/DC converter 2 connected to a battery 1, a capacitor 3 connected to the DC/DC converter 2, an ignition coil 4 having a primary winding and a secondary winding having their one ends commonly connected to the capacitor 3, a signal generator 5 connected to the battery 1, a trigger circuit 6 connected to the battery 1 and the signal generator 5, and a thyristor 7 having an anode connected to a junction between the DC/DC converter 2 and the capacitor 3, a cathode connected to ground and a gate connected to the trigger circuit 6.

The battery 1 generates a voltage of 12 volts for example, and the DC/DC converter 2 boosts the output voltage of the battery 1 to a voltage of 400–500 volts for example.

In operation, the output voltage of the battery 1 is boosted to an appropriate level by the DC/DC converter 2 and supplied to the capacitor 3 to charge it.

The voltage of the thus charged capacitor 3 is discharged through the thyristor 7 when the thyristor 7 is turned on, i.e., at an ignition point of time. A discharging current flows from one end of the capacitor 3 through the thyristor 7 and the primary winding of the ignition coil 4 to the other end of the capacitor 3, so that a spark plug (not shown) connected to the secondary winding of the ignition coil 4 generates a spark for firing an air/fuel mixture in a cylinder.

With the known ignition apparatus as constructed above, the charged voltage of the capacitor 3 is discharged according to a time constant which is determined by the impedance of the primary winding. Accordingly, as the time constant decreases, the discharging becomes faster, so the rising of the output voltage developed at the secondary winding of the ignition coil 4 becomes quicker while making the time for generating a spark shorter. Conversely, as the time constant increases, the longer the sparking time becomes, so the rising of the secondary winding voltage becomes slower. As a result, it is difficult to achieve a quick rising of the secondary winding voltage and a long sparking time at the same time.

SUMMARY OF THE INVENTION

Accordingly, the present invention is intended to obviate the above-described problem encountered with the known ignition apparatus.

An object of the invention is to provide a novel and improved capacitor discharge type ignition apparatus for an internal combustion engine in which a secondary winding voltage rises quickly and which has an extended spark generation time as well.

According to the present invention, there is provided an ignition apparatus for an internal combustion engine comprising:

an electrical power source;

an ignition coil having a primary winding and a secondary winding connected to a spark plug, the primary winding having a first end terminal, a second end terminal and a third intermediate terminal between the first and second end terminals;

a first capacitor connected between the electrical power source and one of the first and second end terminals of the primary winding so that it is charged by the electrical power source;

a second capacitor connected between the electrical power source and the intermediate terminal of the primary winding so that it is charged by the electrical power source;

a signal generator for generating an ignition signal in synchronism with the rotation of the engine; and a switch for causing the first and second capacitors to simultaneously discharge through the primary winding in response to the ignition signal of the signal generator.

In one embodiment, the switch comprises a thyristor which has an anode connected to the first and second capacitors, a cathode connected to ground, and a gate connected to the signal generator through a trigger circuit. A converter is provided for boosting the output voltage of the electrical power source to be supplied to the first and second capacitors. The first and second capacitors have one end thereof connected in common to the converter and the anode of the thyristor. The first capacitor has the other end thereof connected to the first end terminal of the primary winding which is connected at its second end terminal to ground. The second capacitor has the other end thereof connected to the third intermediate terminal of the primary winding. A first diode has an anode connected to a node between the first capacitor and the first end terminal of the primary winding, and a cathode connected to ground. A second diode has an anode connected to a node between the second capacitor and the third intermediate terminal of the primary winding.

Preferably, the secondary winding of the ignition coil has a first end terminal, a second end terminal connected to the second end terminal of the primary winding, and a third intermediate terminal. A pair of diodes have their cathodes connected to the first end terminal and the third intermediate terminal of the secondary winding, and their anodes connected in common to the spark plug.

In another embodiment, the switch comprises a thyristor which has an anode connected to the second end terminal of the primary winding, a cathode connected to ground, and a gate connected to the signal generator through a trigger circuit. A converter is provided for boosting the output voltage of the electrical power source to be supplied to the first and second capacitors. The first end terminal and the third intermediate terminal of the primary winding are connected in common to the converter through a first and a second diode, respectively. The first capacitor has one end thereof connected to a node between the converter and the first end terminal of the primary winding and the other end thereof connected to ground. The second capacitor has one end thereof connected to a node between the converter and the third intermediate terminal of the primary winding and the other end thereof connected to ground. A diode has a cathode connected to a node between the first diode and the first capacitor and an anode connected to ground. Another diode has a cathode connected to a node between the second capacitor and the third intermediate terminal of the primary winding and an anode connected to ground.

The above and other objects, features and advantages of the present invention will more readily apparent form the following detailed description of a few preferred embodiment of the invention taken in conjunction with the accompanying drawings.

BRIEF DESCRIPTION OF THE DRAWINGS

FIGS. 2(*a*)–2(*g*) are waveform diagrams showing the waveforms of signals at various portions of the apparatus of FIG. 1;

DESCRIPTION OF THE PREFERRED EMBODIMENTS

A few preferred embodiments of the present invention will now be described in detail while referring to the accompanying drawings.

Figure 1:
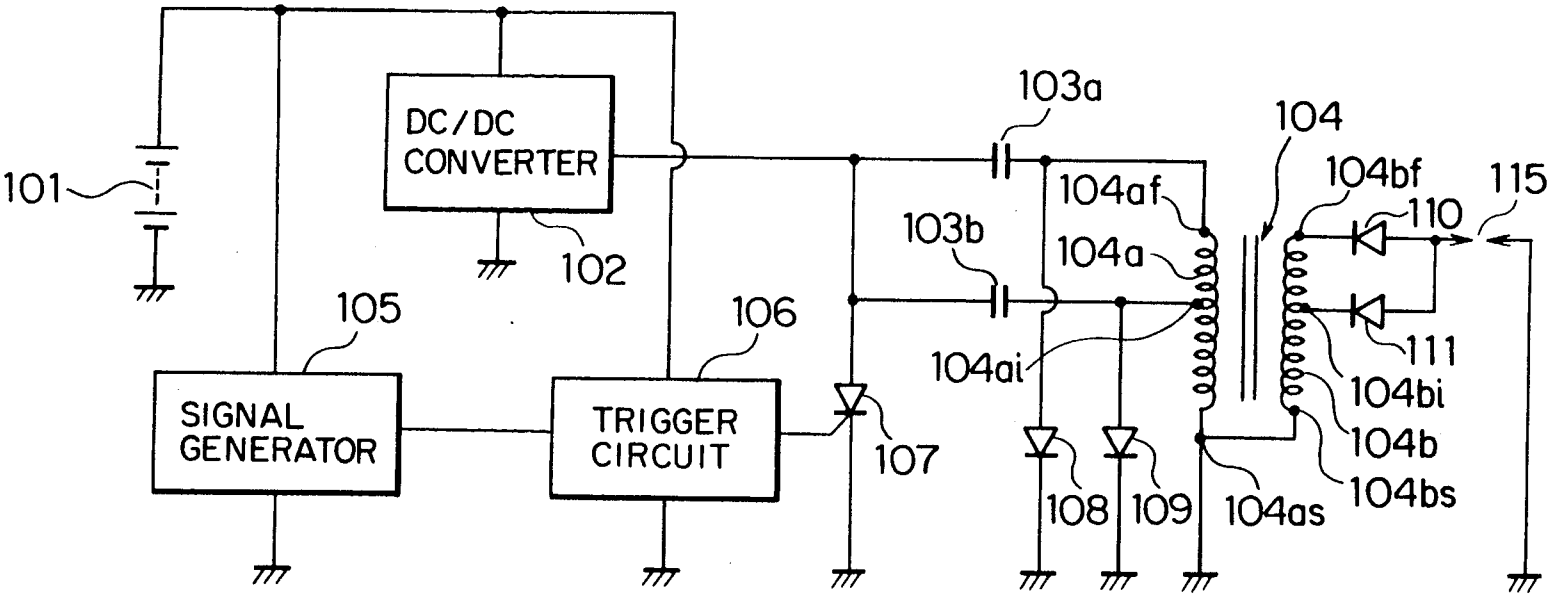
FIG. 1 is a circuit diagram of an ignition apparatus for an internal combustion engine in accordance with a first embodiment of the invention.
Figure 4:
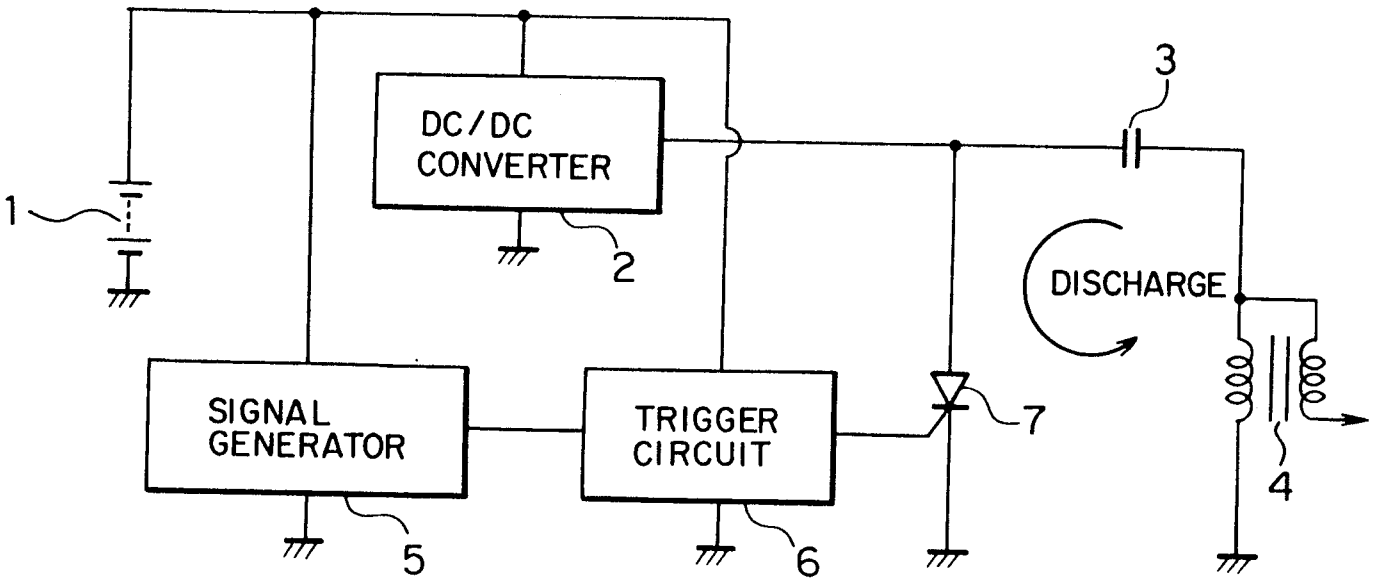
FIG. 4 PRIOR ART
FIG. 4 is a view similar to FIG. 1, but showing a known ignition apparatus for an internal combustion engine.

Referring first to FIG. 1, there is diagrammatically shown an ignition apparatus for an internal combustion engine constructed in accordance with the present invention. The apparatus illustrated includes an electrical power source 101 in the form of a battery, a converter 102 in the form of a DC/DC converter, a signal generator 105 and a switch in the form of a thyristor 107, all of which are the same as the elements 1, 2, 5 and 7 of the above-described known apparatus of FIG. 4. In addition to these elements 101, 102, 105 and 107, the apparatus of the invention includes a pair of first and second capacitors 103*a*, 103*b* having their one end commonly connected to the DC/DC converter 102 and an anode of the switching means 107 in the form of a thyristor which has a cathode connected to ground, and an ignition coil 104 having a primary winding 104*a* and a secondary winding 104*b*. The primary winding 104*a* has a first end terminal 104*af* connected to one end of the first capacitor 103*a*, a second end terminal 104*as* connected to ground, and an intermediate terminal 104*ai* connected to the other end of the second capacitor 103*b*. A diode 108 has an anode connected to a node between the first capacitor 103*a* and the first end terminal 104*af* of the primary winding 104*a*, and a cathode connected to ground. A diode 109 has an anode connected to a node between the second capacitor 103*b* and the intermediate terminal 104*ai* of the primary winding 104*a*, and a cathode connected to ground. The secondary winding 104*b* has a first end terminal 104*bf* connected to a cathode of a diode 110 having an anode thereof connected to one end of a spark plug 115 which in turn is connected at the other end thereof to ground, a second end terminal 104*bs* connected to the second end terminal 104*as*, and an intermediate terminal 104*bi* corresponding to the intermediate terminal 104*ai* and connected to a cathode of a diode 111 which has an anode thereof connected to the other end of the spark plug 115.

The operation of the above embodiment will now be described in detail while referring to FIGS. 2(*a*) through 2(*g*).

First, the DC/DC converter 102 boosts the output voltage of the battery 101 which charges the first and second capacitors 103*a*, 103*b*, as shown in FIG. 2(*b*). In this connection, the diodes 108, 109 serve to prevent the capacitors 103*a*, 103*b* from being charged by the DC/DC converter 102 with their polarities directed in the opposed direction.

The charged capacitors 103*a*, 103*b* discharge their accumulated electrical energy through the thyristor 107 when the thyristor 107 is turned on by trigger pulses in the trigger signal, as shown in FIG. 2(*a*), which is supplied to the gate of the thyristor 107 by the ignition signal generator 105 through the trigger circuit 106. The discharging path for the first capacitor 103*a* is such that a discharging current flows from the one end of the capacitor 103*a* to the other end thereof by way of the thyristor 107 and the primary winding 104*a* of the ignition coil 104. The discharging current ia from the capacitor 103*a* is determined by a time constant which in turn is determined by constants La, Ra at the first and second end terminals 104*af*, 104*as*, respectively, of the primary winding 104*a*. Also, the discharging path for the second capacitor 103*b* is such that a discharging current flows from the one end of the capacitor 103*b* to the other end thereof by way of the thyristor 107, the second end terminal 104*as* and the intermediate terminal 104*ai* of the primary winding 104*a*. The discharging current ib for the second capacitor 103*b* is determined by a time constant which in turn is calculated on the basis of constants Lb, Rb, respectively, at the second end terminal 104*as* and the intermediate terminal 104*ai* of the primary winding 104*a*.

Since the above constants La, Lb and Ra, Rb have the relationships of La>Lb and Ra>Rb, the discharging current ia for the first capacitor 103*a* having a time constant of a large value gradually rises and falls, flowing at a relatively slow rate for an extended period of time, as shown in FIG. 2(*c*), whereas the discharging current ib for the second capacitor 103*b* having a time constant of a small value sharply rises and falls, flowing at a fast rate for a short period of time, as shown in FIG. 2(*d*). Accordingly, the total current flowing through the primary winding 104*a*, which is the sum of the discharging currents ia, ib, sharply rises but gradually falls, thus flowing slowly for an extended period of time, as shown in FIG. 2(*e*), so an output voltage generated at the secondary winding 104*b* by the total current (ia+ib) sharply rises and generates a spark for a longer period of time. As a result, stable firing can be ensured without fail, thus improving combustion efficiency.

In this regard, although the efficiency of current to voltage conversion of the ignition coil 104 is somewhat reduced by differences between the constants La, Lb and between the constants Ra, Rb, it is substantially improved by connecting the output terminal or the first end terminal 104*bf* and the intermediate terminal 104*bi* to each other through the diodes 110, 111.

As will be evident from the foregoing, according to this embodiment, the primary winding 104i a of the ignition coil 104 is provided with the intermediate tap or terminal 104*ai* so that two discharging paths or circuits for the first and second capacitors 103*a*, 103*b* having two different time constants of large and small values are formed and connected to the primary winding 104*a* in a parallel relation. With this arrangement, the output of one of the two discharging circuits, which has a small time constant and contains a sharply rising pulse, is superimposed on the output of the other discharging circuit, which has a large time constant and contains a pulse having an extended spark generation time, to generate a total output voltage which sharply rises and has a long spark generation time.

Figure 3:
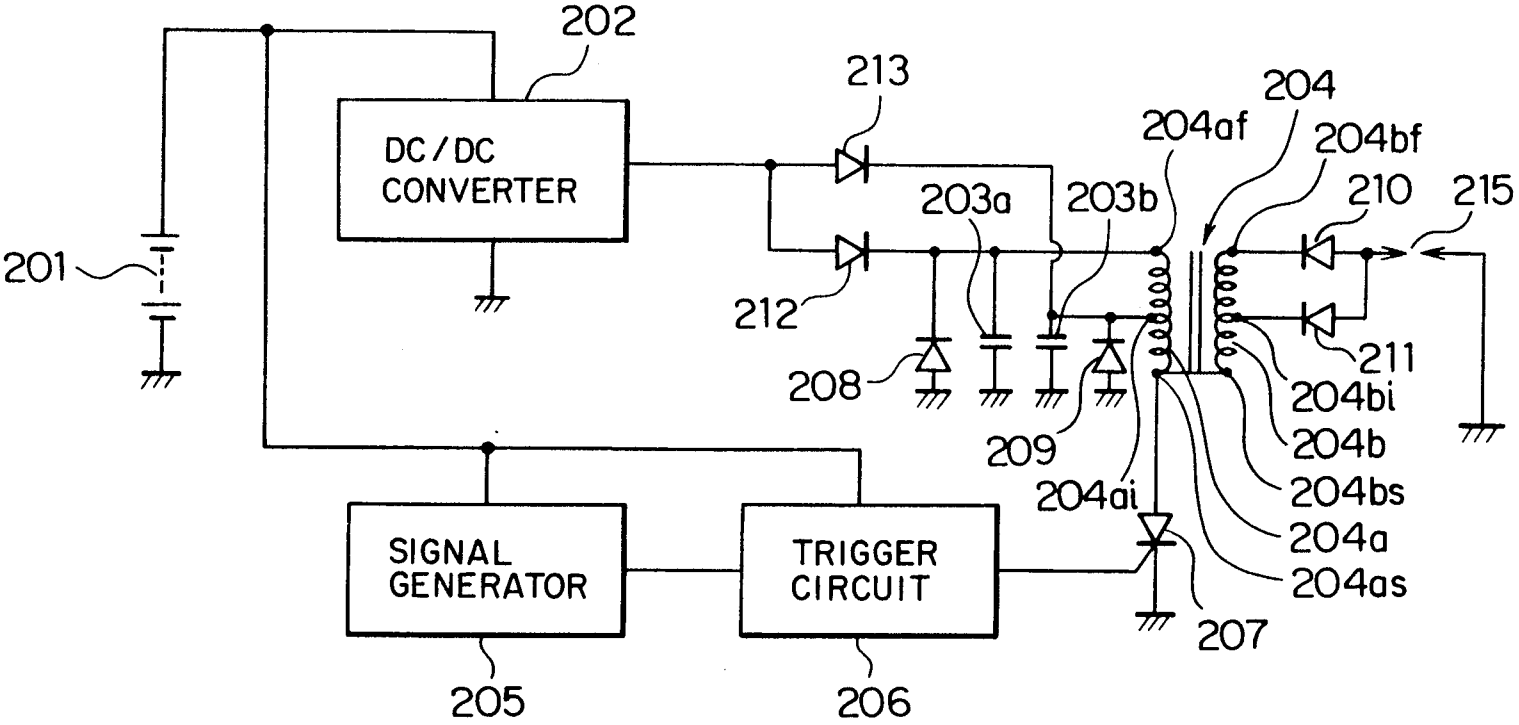
FIG. 3 is a view similar to FIG. 1, but showing another embodiment of the invention.

FIg. 3 shows another embodiment of the present invention which differs from the previous embodiment of FIG. 1 only in the arrangement of the first and second capacitors, thyristor and diodes. Specifically, this embodiment includes a battery 201, a DC/DC converter 202, an ignition coil 204 having a primary winding 204*a* and a secondary winding 204*b*, an ignition signal generator 205, a trigger circuit 206, a thyristor 207, and a pair of parallel connected diodes 210, 211, all of which are the same as the elements 101, 102, 104, 105, 106, 107, 110 and 11 of FIG. 1 and are connected substantially in the same manner as in FIG. 1. In this embodiment, the primary winding 204*a* of the ignition coil 204 has a first end terminal 204*af* connected to a cathode of a diode 212 which has an anode connected to the DC/DC converter 202, a second end terminal 204*as* connected to an anode of the thyristor 207 and to a second end terminal of the secondary winding 204*b*, and an intermediate terminal or tap 204*ai* connected to a cathode of a diode 213 which has an anode connected to the DC/DC converter 202. A first capacitor 203*a* has one end thereof connected to a node between the diode 212 and the first end terminal of the primary winding 204*a*, and the other end thereof connected to ground. A diode 208 has a cathode connected to a node between the diode 212 and the first capacitor 203*a*, and an anode connected to ground. A second capacitor 203*b* has one end thereof connected to a node between the diode 213 and the intermediate terminal 204*ai* of the primary winding 204*a*, and the other end thereof connected to ground. A diode 209 has a cathode connected to a node between the second capacitor 203*b* and the intermediate terminal 204*ai* of the primary winding 204*a*, and an anode connected to ground.

In this embodiment, a discharging current flows from the one end of the first capacitor 203*a* to the other end thereof by way of the first end terminal 204*af* and the second end terminal 204*as* of the primary winding 204*a* and the thyristor 207, whereas a discharging current flows from one end of the second capacitor 203*b* to the other end thereof by way of the intermediate terminal 204*ai* and the second end terminal 204*as* of the primary winding 204*a* and the thyristor 207. Although the discharging currents for the first and second capacitors 203*a*, 203*b* flow in a direction reverse to that in which discharging currents for the capacitors 103*a*, 103*b* of FIG. 1 flow, this embodiment provides substantially the same results as obtainable with the FIG. 1 embodiment.

Although in the above embodiments, the primary windings 104*a*, 204*a* of the ignition coils 104, 204 have one intermediate terminal or tap 104*ai*, 204*ai* and the two capacitors 103*a*, 103*b*; 203*a*, 203*b* are employed which are connected to the primary windings 104*a*, 204*a* of the ignition coils 104, 204 in a parallel relation, the primary windings may have two or more intermediate terminals or taps and three or more capacitors can be used, each of which is connected between any two of the first and second end terminals and the intermediate terminals of the primary windings, while providing substantially the same results.

In additon, in the above embodiments, the diodes 110, 111 and 210, 211 connected in parallel to the secondary winding 104*b*, 204*b* of the ignition coils 104, 204 can be omitted as necessary without any substantial problem.

What is claimed is:

1. An ignition apparatus for an internal combustion engine comprising:

an electrical power source;

an ignition coil having a single, discrete unidirectionally wound primary winding and a secondary winding connected to a spark plug, the primary winding having a first end terminal, a second, opposite end terminal and a third intermediate terminal between the first and second end terminals;

a first capacitor connected between said electrical power source and one of the first and second end terminals of the primary winding so that it is charged by said electrical power source;

a second capacitor connected between said electrical power source and the intermediate terminal of the primary winding so that it is charged by said electrical power source;

a signal generator for generating an ignition signal in synchronism with the rotation of the engine; and a switch for causing said first and second capacitors to simultaneously discharge through the primary winding in response to the ignition signal of said signal generator.

2. An ignition apparatus according to claim 1, wherein said switch comprises a thyristor which has an anode connected to said first and second capacitors, a cathode connected to ground, and a gate connected to said signal generator through a trigger circuit.

3. An ignition apparatus according to claim 2, further comprising a converter for boosting the output voltage of said electrical power source to be supplied to said first and second capacitors.

4. An ignition apparatus according to claim 3, wherein said first and second capacitors have one end thereof connected in common to said converter and the anode of said thyristor, said first capacitor having the other end thereof connected to the first end terminal of the primary winding which is connected at its second end terminal to ground, said second capacitor having the other end thereof connected to the third intermediate terminal of the primary winding.

5. An ignition apparatus according to claim 4, further comprising a first diode having an anode connected to a node between the first capacitor and the first end terminal of the primary winding, and a cathode connected to ground, and a second diode having an anode connected to a node between the second capacitor and the third intermediate terminal of the primary winding.

6. An ignition apparatus according to claim 1, wherein the secondary winding of said ignition coil has a first end terminal, a seond end terminal connected to the second end terminal of the primary winding, and a third intermediate terminal, said ignition apparatus further comprising a pair of diodes which have their cathode connected to the first end terminal and the third intermediate terminal of the secondary winding, and their anode connected in common to the spark plug.

7. An ignition apparatus according to claim 1, wherein said switch comprises a thyristor which has an anode connected to the second end terminal of the primary winding, a cathode connected to ground, and a gate connected to said signal generator through a trigger circuit.

8. An ignition apparatus according to claim 7, further comprising a converter for boosting the output voltage of said electrical power source to be supplied to said first and second capacitors.

9. An ignition apparatus according to claim 8, wherein the first end terminal and the third intermediate terminal of the primary winding are connected in common to said converter through a first and a second diode, respectively, said first capacitor having one end thereof connected to a node between said converter and the first end terminal of the primary winding and the other end thereof connected to ground, said second capacitor having one end thereof connected to a node between said converter and the third intermediate terminal of the primary winding and the other end thereof connected to ground.

10. An ignition apparatus according to claim 9, further comprising a diode which has a cathode connected to a node between said first diode and said first capacitor and an anode connected to ground, and another diode which has a cathode connected to a node between said second capacitor and the third intermediate terminal of the primary winding and an anode connected to ground.

* * * * *